US005138299A

United States Patent [19]

Patten et al.

[11] Patent Number: 5,138,299

[45] Date of Patent: Aug. 11, 1992

[54] SHOWCASE ALARM SYSTEM

[75] Inventors: James F. Patten, Tustin; Allan F. V. Buskirk, Fountain Valley, both of Calif.

[73] Assignee: Honeywell Inc., Minneapolis, Minn.

[21] Appl. No.: 666,277

[22] Filed: Mar. 7, 1991

[51] Int. Cl.[5] ..... G08B 13/08

[52] U.S. Cl. ..... 340/545; 340/529; 340/309.15; 70/267

[58] Field of Search ..... 340/545, 529, 527, 528, 340/309.15, 570, 542, 543, 686, 309.2, 309.3, 309.4, 309.5, 309.6, 825.31, 825.32; 109/38; 70/267, 268, 269

[56] References Cited

U.S. PATENT DOCUMENTS 3,686,660 8/1972 Massover ..... 340/545
3,757,319 9/1973 Hedin ..... 340/545
3,803,576 4/1974 Dobrzanski ..... 340/545
4,920,333 4/1990 Barr ..... 340/545

*Primary Examiner*—Jin F. Ng
*Assistant Examiner*—Christine K. Oda

[57] ABSTRACT

An alarm system for use in store showcases. The alarm system includes a door switch, a timer, a user actuable shunt switch, a lock switch and door alarm logic. Prior to opening a showcase door, the shunt switch is actuated causing the time to produce a signal which disables the door alarm logic for a first predetermined time period. The sales person then has a first predetermined time period to enter the showcase, remove the desired merchandise, and close the showcase. Failure to close the showcase door in time, or opening the showcase door without actuating the shunt switch, causes the door alarm logic to activate, and the salesperson is notified of the open door. The lock switch can be actuated to disable the alarm logic for a second time period.

3 Claims, 2 Drawing Sheets

SHOWCASE ALARM SYSTEM

BACKGROUND OF THE INVENTION

This invention is directed toward the field of alarm systems and more particularly to the field of intrusion alarm systems.

Many retailers have used showcases to display their goods. Sales people frequently entered the showcases in order to show goods stored in the cases to interested customers.

Unfortunately, the showcases were often left open after the sales person had returned the goods to the showcase and walked away. Thereafter, a thief was left with easy access to the goods in the showcase.

In addition, occasionally showcases were located in an area where continuous surveillance by store employees was not possible. Thieves often broke into these showcases and stole their contents.

To solve these problems, stores often put locks on the cases. Occasionally, however, store employees would leave the showcase open after showing merchandise to customers or stocking the showcase with merchandise.

While burglar and intrusion alarms are commonly available, these systems are often expensive and difficult to install.

It is therefore an object of the present invention to provide a reminder to sales people to close a showcase after it has been opened. It is a further goal of the present invention to alert store employees of an attempted unauthorized entry into a showcase. It is yet another goal of the present invention to alert employees if the showcase is left open for a predetermined period of time. It is still another object of the present invention to provide the foregoing objects in an inexpensive, easy to install and reliable alarm system.

SUMMARY OF THE INVENTION

The present invention is a showcase alarm system which accomplishes the forgoing objectives. The alarm system includes a door position sensing means, a timer including a means for generating a first time period, a user actuable shunt switch, door alarm logic including means for generating a first door alarm signal and an indicating means. The door position sensing means is attached to the showcase door and electrically connected to the door alarm logic. The shunt switch is electrically connected to the means for generating a first time period. The indicating means is electrically connected to the door alarm logic.

To open the door, the shunt switch is actuated causing the means for generating a first time period to produce a signal which disables the door alarm logic for a first predetermined time period. The sales person then has a time period equal to the first predetermined time to enter the showcase, remove the desired merchandise and close the showcase. Closing the showcase causes the means for generating a first time period to reset. Failure to close the showcase door after the first predetermined time has countdown or opening the showcase door without actuating the shunt switch causes the first door open alarm means of the door alarm logic to immediately send an alarm signal to the indicating means.

A second embodiment of the present invention can be used on showcases having two or more doors. In the second embodiment, a second door position means is used to determine the position of a second door. A means for generating a second door open signal can be included as part of the door alarm logic. The means for generating a second door alarm signal causes an immediate signal to be sent to the indicating means if both doors are open at the same time.

Finally, with either the first or second embodiments, a lock switch and means for generating a second time period may be used to insure that employees relock a showcase after restocking the showcase with merchandise. The lock switch is electrically connected to the timer which includes the means for generating a second time period. The means for generating a second time period in turn is electrically connected to the door alarm logic. When the lock switch is actuated, the means for generating a second time period disables the door alarm logic and begins to count a second predetermined time period. If the lock switch has not be deactuated before the means for generating a second time period measures the second predetermined time period, the door alarm logic sends an alarm signal to the indicating means.

The indicating means may be for example a light, an audible indicator, or a combination of both.

DETAILED DESCRIPTION OF THE PREFERRED EMBODIMENT

Figure 1:
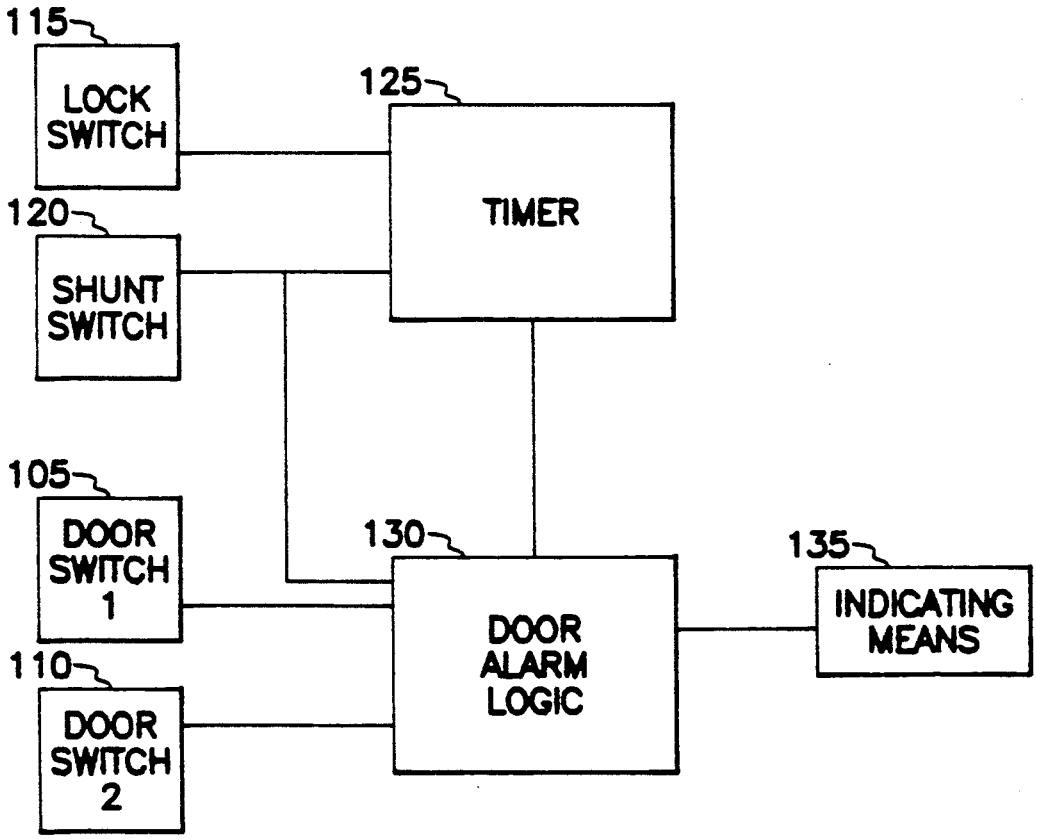
FIG. 1 is a block diagram of the alarm system of the present invention.

Referring now to FIG. 1, thereshown is an exemplary embodiment of the presently inventive alarm system 100. The alarm system includes a first door door switch 105, a second door door switch 110, lock switch 115, shunt switch 120, timer 125, door alarm logic 130 and indicating means 135.

First door switch 105 is connected to the door of a showcase which is to be monitored. If the show case has a second door, second door switch 110 is then attached to the second door. In either case, the door switches produce a door open signal or a door closed signal, indicative of door position. Any door switch included in the system is connected to timer 125 and door alarm logic 130.

Figure 3:
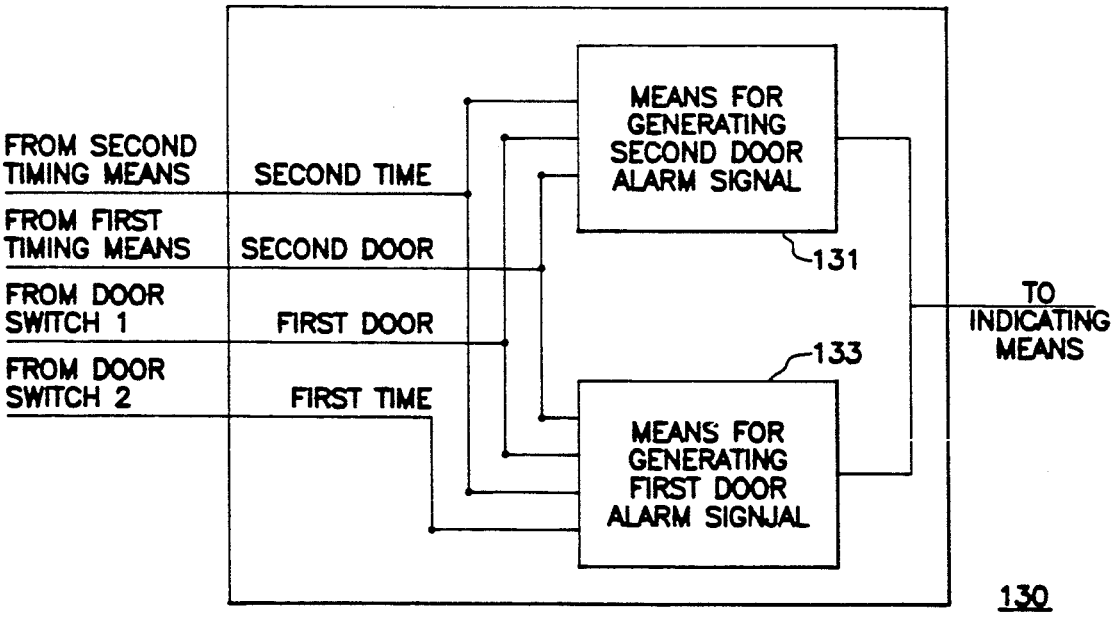
FIG. 3 is a block diagram of the door alarm logic.

Door alarm logic 130 can be better viewed with reference to FIG. 3. Thereshown is the door alarm logic 130 which includes means for generating a first door open signal 131 and means for generating a second door open signal 133.

Means for generating a first door alarm signal 131 (hereinafter first door alarm means) is necessary to the system. It produces an alarm signal any time a showcase door is opened as indicated by the signals received from the first or second door position means so long as the timer has not produced a disable signal. If the timer has sent a disable signal to the first door alarm means, no alarm signal is produced when door open signals are received. The first door alarm means can be easily produced using for example an OR gate having the door position means outputs as inputs and an AND gate having an as inputs the OR gate output and the output from the timer (not shown).

The means for generating a second door alarm signal (hereinafter second door alarm means) 133 is connected to all of the door position sensing means and the indicating means. The second door alarm means produces the alarm signal if more than one door position sensing means is producing a door open signal simultaneously. The second door alarm means is an additional feature which is not necessary for the basic invention to operate properly.

Figure 2:
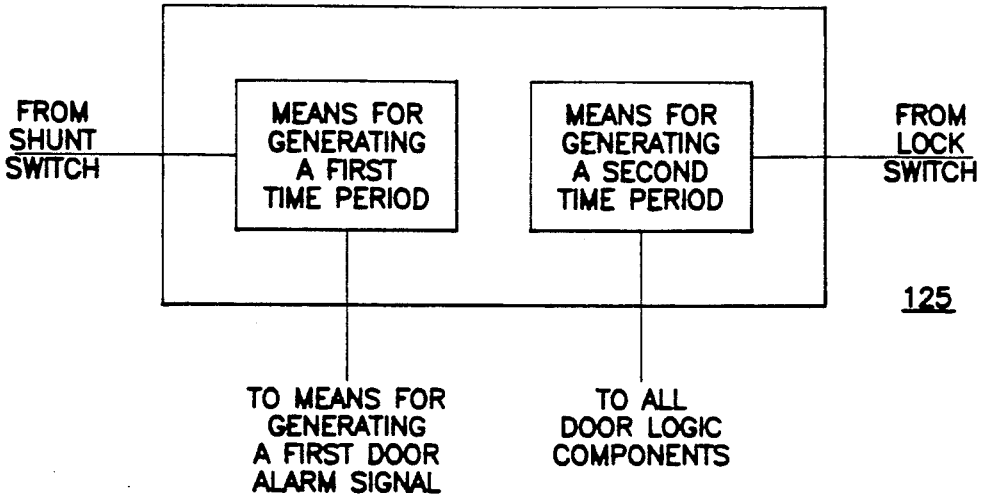
FIG. 2 is a block diagram of the timer.

Timer 125 can best be viewed with reference to FIG. 2. FIG. 2 shows that timer 125 includes two main parts: means for generating a first time period 125A (hereinafter first timing means) and means for generating a second time period 125B (hereinafter second timing means).

The first timing means 125A is connected to the shunt switch 120. When a sales person desires access to the protected showcase, they must actuate the shunt switch. This in turn causes first timing means 125A to measure a first predetermined period. During the first predetermined period, the first timing means produces a disable signal which causes the first door alarm means 131 to not produce any alarm signals. Once the first timing means has reached the first predetermined time period, the disable signal ceases. One suggested first predetermined time period is fifteen seconds. The first timing means is necessary for the basic invention.

Occasionally, it may be desirable to keep the showcase doors open for an extended period of time, for example, to restock merchandise. Means for generating a second time period 125B (hereinafter second timing means) is used to measure a second time period which can be significantly longer than the first time period. The second timing means is connected to a lock switch 115. The lock switch may be, as examples, a switch which requires a key to actuate, or may be an electronic keypad into which a code number is entered. In any case, the lock switch produces a disarm signal when actuated. This in turn causes the second timing means to disable all functions of the door alarm logic for a second predetermined time period. Upon deactuation of the lock switch or expiration of the second predetermined time period, all functions of the door alarm logic are re-enabled.

One example of an acceptable timer is the Motorola TM MC14538B chip.

Indicating means 135 is connected to the door alarm logic 130. If the door alarm logic produces an alarm signal, the indicating means presents provides an alarm which a human operator can perceive. The indicating means may include a light, an audible alarm such as a bell, horn or buzzer, or a combination of visual and audible alarms.

The foregoing has been a description of a novel and non-obvious alarm system. The applicants do not intend this description to be limiting, but instead define the limits of the invention through the claims appended hereto.

We claim:

1. An alarm system, comprising:

a first door switch for producing a door open signal and a door closed signal indicative of door position;

a user actuable shunt switch;

a user actuable lock switch;

indicating means for indicating occurrence of an alarm signal;

a door alarm logic;

a timer comprised of a means for generating a first time period electrically connected to said shunt switch, actuation of said shunt switch causing said means for generating a first time period to produce a disable signal for a first predetermined period, said timer further comprising a means for generating a second time period electrically connected to said lock switch and said door alarm logic, said means for generating a second time period being adapted to disable said door alarm logic for a second predetermined time period when said lock switch is actuated; and said door alarm logic comprised of means for generating a first door alarm signal connected to said first door switch, said timer and said indicating means adapted to produce said alarm signal if said first door switch produces a door open signal when said disable signal is not being produced.

2. The alarm system of claim 1, further comprising:

a second door switch for generating a door open signal and a door closed signal indicative of a second door position in electrical connection with said door alarm logic.

3. The alarm system of claim 2, wherein said door alarm logic further comprises:

means for generating a second door alarm signal which produces said alarm signal if said first and second door switches are producing a door open signal simultaneously.

* * * * *